US006612075B1

(12) United States Patent
Knoop et al.

(10) Patent No.: US 6,612,075 B1
(45) Date of Patent: Sep. 2, 2003

(54) TEMPORARY FLEXIBLE DOWNPIPE

(76) Inventors: Max Knoop, 4/4 Patrick Court, Seaford, Victoria 3198 (AU); Damian Knoop, 4/4 Patrick Court, Seaford, Victoria 3195 (AU)

( * ) Notice: Subject to any disclaimer, the term of this patent is extended or adjusted under 35 U.S.C. 154(b) by 0 days.

(21) Appl. No.: 09/646,229

(22) PCT Filed: Mar. 12, 1998

(86) PCT No.: PCT/AU98/00154

§ 371 (c)(1),
(2), (4) Date: Oct. 27, 2000

(87) PCT Pub. No.: WO99/46462

PCT Pub. Date: Sep. 16, 1999

(51) Int. Cl.[7] ..... E04D 13/08

(52) U.S. Cl. ..... 52/16; 239/195; 138/118; 138/DIG. 1

(58) Field of Search ..... 52/16; 239/195, 239/196; 138/109, 118, 119, DIG. 1; 285/8, 5, 18, 33

(56) References Cited

U.S. PATENT DOCUMENTS

| | | | | | |
|---|---|---|---|---|---|
| 2,898,939 | A | * | 8/1959 | Fox | 405/119 |
| 3,035,779 | A | * | 5/1962 | Convis | 239/208 |
| 3,937,641 | A | * | 2/1976 | Kushner et al. | 156/87 |
| 3,966,121 | A | | 6/1976 | Littman | |
| 5,743,570 | A | * | 4/1998 | Garland | 285/8 |
| 5,772,616 | A | * | 6/1998 | Competiello et al. | 601/165 |
| 5,813,701 | A | * | 9/1998 | Noble | 285/4 |
| 5,867,944 | A | * | 2/1999 | Attaway | 52/16 |

FOREIGN PATENT DOCUMENTS

| | | |
|---|---|---|
| AU | 3555493 | 10/1993 |
| AU | 6575996 | 3/1997 |
| CA | 2186931 | 9/1997 |
| WO | 9403688 | 2/1994 |

OTHER PUBLICATIONS

P. Lorriel & C. Garratt, *Ironhouse*, Dolphin Books, New York, photgraph at p. 160 (published 1987).
Ivo Peters, *The Train Now Departing*, BBC Books, London, photographs at pp. 128, 143 (top), 155 (published 1989).

* cited by examiner

*Primary Examiner*—Carl D. Friedman
*Assistant Examiner*—Jennifer I. Thissell
(74) *Attorney, Agent, or Firm*—Edwin D. Schindler

(57) ABSTRACT

A temporary water drainage system having a tubular length of flexible water-proof material (25) and a fastening device (15) on at least one end where the material (25) can be connected to a water source (20). The fastening device (15) may be an adhesive material or it could be a form of clamp (26) or a sleeve which passes over the tubular length of flexible water-proof material (25). The length of flexible water-proof material (25) may, at its end away from the water source be connected to a stormwater drain or the like or can pass any water received therein to waste in some other way.

18 Claims, 2 Drawing Sheets

TEMPORARY FLEXIBLE DOWNPIPE

This invention relates to a means for a temporary water diversion system, in particular a means for a temporary conduit for diverting water from a water source to a drainage area.

Conduits provide a means to relocate water from a water source to a drainage area. A well known example of a conduit is a downpipe.

Downpipes are commonly used to relocate water from roofs of structures to drainage areas, such as storm water drains, water storage tanks, or natural run-off areas. Downpipes are used in many different types of structures, for example, buildings, dwellings, houses, sheds, and the like.

Builders may encounter many problems when building a house. A particular problem is the diversion of water from the roof away from the building site.

A common problem when building a house is that if it rains the roof will collect water and this will pour to the spout. Naturally, as this has no down pipe system installed for the effective removal of this water, the water may overflow from the roof and cause damage when it flows down the finished brickwork, glasswork or plasterwork. Failure to control the flow of this water can also cause other problems such as soil erosion around the foundations.

Some builders overcome this problem by installing permanent downpipes on completion of the roof, but before the building process is finished. Unfortunately, the installed downpipes are commonly damaged during the remainder of the building process and have to be replaced. For example, if a "Colourbond" (Trade Mark) downpipe is scratched or dented, it is effectively ruined and the builder would be required to replace it.

It is the object of the present invention to overcome the abovementioned problems by providing a temporary conduit for diverting water from a water source to a drainage area.

The invention, in its broadest sense, comprises a temporary water drainage system having a tubular length of flexible water-proof material and a fastening device on at least one end where the material can be connected to a water source.

In practice, one end of the flexible water-proof material is connected by a fastening device to a collection member at the water source and, if required, the other end is connected by a fastening device to a drainage area.

In order that the invention may be more readily understood, we shall describe a preferred embodiments of the invention in relation to the accompanying drawings, in which.

In a first embodiment of the invention the temporary water diversion system is used as a temporary downpipe for a roof guttering 20. Adhesive members 15 which may be pieces of double-sided foam tape, are affixed to the exterior perimeter of the existing roof guttering outlet member 16.

Figure 1:
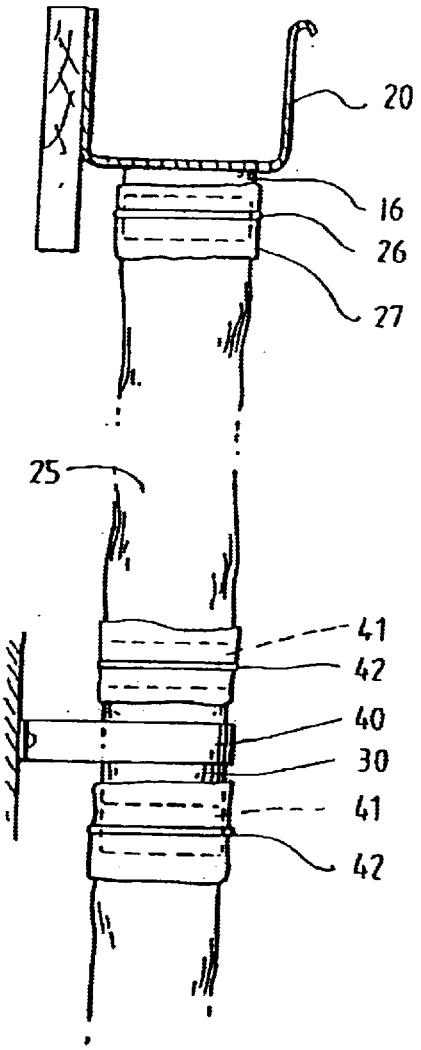
FIG. 1 is a side elevation showing the temporary water drainage system in position.
Figure 2:
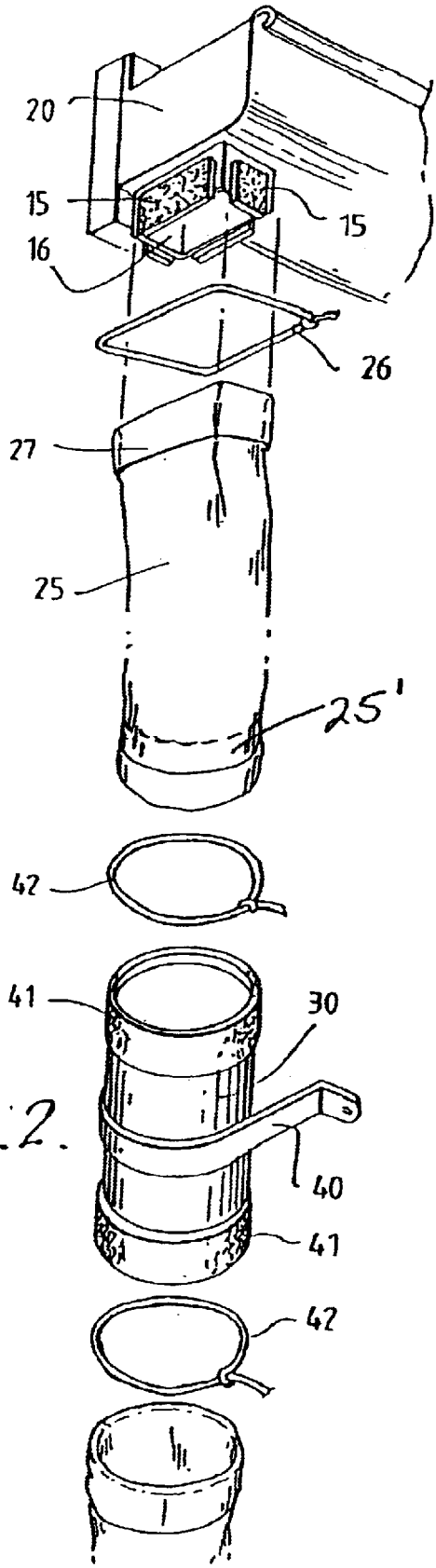
FIG. 2 is a perspective view, partly broken to show the components of the system.
Figure 3:
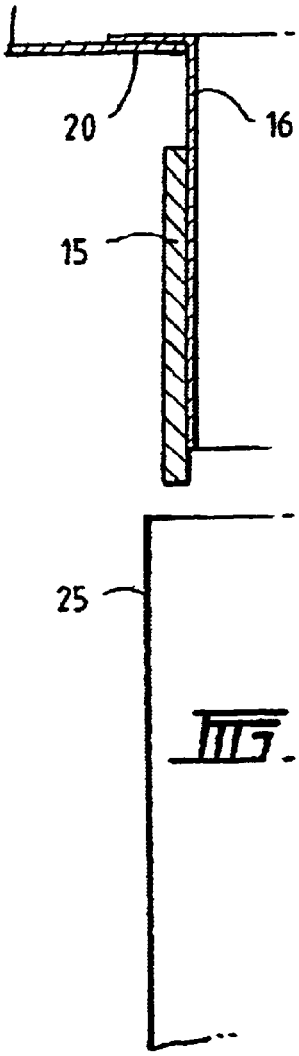
FIGS. 3 and 4 show a method of connecting a sleeve to the outlet of a drain pipe.
Figure 4:
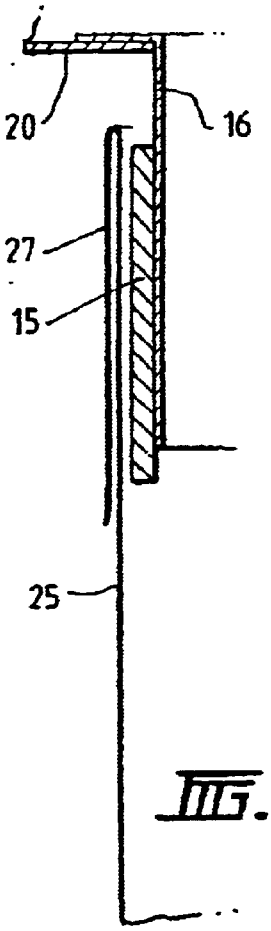
Figure 5:
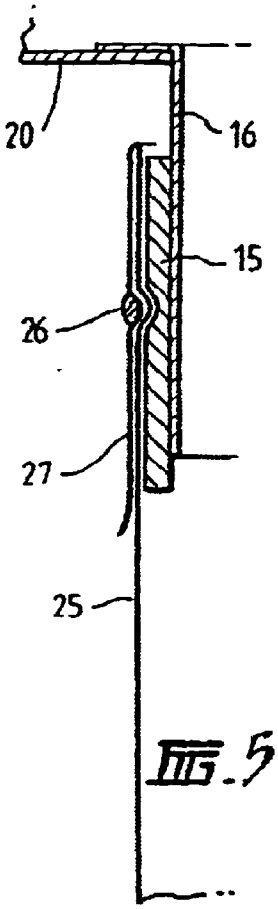
FIG. 5 shows a first method of connecting the components.

The interior surface of one end of a tube 25 of flexible waterproof material, such as a polythene material, is attached thereto. It is preferred that the end of the plastic tube have a returned end 27. The arrangement can well be seen in FIGS. 3 to 5. A secondary fastening device 26, such as a cable tie, is then applied over the exterior of the polythene tube so that when the cable tie 26 is pulled tight it compresses the polythene material onto the tape 15, causing indentation in the tape and ensuring a water seal between the components.

When in use, water passes from the roof guttering 20 to the outlet 16 and into the tubular plastics material 25 and flows down the temporary drainpipe.

Preferably, the lower end of the tube 25 may be connected to a lower member which,in turn, is connected to a storm water drain or to a satisfactory position to allow run-off. Optionally, one or more weighted members 25' (shown in phantom) in the free end of the tubular length of flexible water-proof material 25 for locating position, may be included.

In the illustrated embodiment, there is an intermediate connecting member 30 between two temporary downpipes. In this case the intermediate member 30 may be connected to a wall 42 of the structure by way of a bracket 40. In this arrangement, the intermediate member 30 has double sided tape 41 about each of its upper and lower ends. The adjacent ends of the tubular members may have a return and are placed over and connected to the tapes 41 and cable ties 42 are then placed around the intermediate member as discussed above.

An arrangement such as this is desirable where there is adverse weather such as strong winds, or that the required length of downpipe which could, for example be of substantial length, as from a two story building, needs a supporting member.

Figure 6:
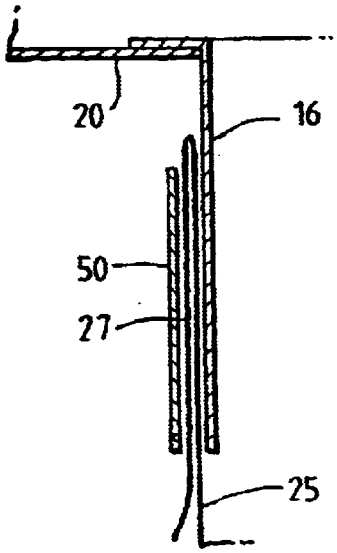
FIG. 6 shows an alternative method of connecting the components.

Whilst the concept of using an adhesive tape provides a satisfactory arrangement, we can, as an alternative, use a sleeve 50 which can fit around the outlet 16 with the plastic tubular member located therebetween. This arrangement is illustrated in FIG. 6. This sleeve can either be of an internal form slightly smaller than the outlet and can be forced thereover and in this way will hold the sleeve in position.

Alternatively, the sleeve may be of a resilient material which can be deformed to pass over the outlet and, once in position, can maintain a pressure on the tubular member to prevent displacement thereof even when it is carrying a substantial quantity of water.

As described hereinabove the tubular flexible waterproof material may be in the form of polythene or any other flexible waterproof material such as a woven plastic tube, aluminium flexible ducting or the like. The adhesive device may be in the form of a piece of double sided foam tape or any other adhesive device such as glue or the like. The secondary fastening device may be in the form of a cable tie or any other clamping device such as an o-ring, wire cable, Velcro strap or the like. A further fastening device may be in the form of heat shrink process or a vacuum seal process.

In a second embodiment, the invention is used to direct water away from the house or other building being built. In many applications the storm water drains may not have been installed or connected, when run off can occur from the spouting system and, generally, what happens under these circumstances is that the rain is delivered through the spouting outlets over a relatively small area, and the water so delivered can often flow back beneath the house and cause damages to the foundations.

In the second aspect of the invention, we connect the plastic tubular member at one end to the outlet, as described in the previous embodiment, but in this case the length of the tubular member is sufficient to reach the ground and to travel along the ground surface for a distance sufficient to lead the water into a drain along the edge of the road, a trench drain, or into some area where the natural absorptance of the soil can accept the water being passed.

Where this is done it is desired to locate the tubular member to terminate at the required position.

One way in which this can be done, is simply to place something relatively heavy, such as a brick or the like in the outlet of the plastics member.

In a slightly more sophisticated arrangement, I may provide a container, such as an open mesh container which contain gravel or the like, which member can be placed into the flexible plastics member adjacent the outer end thereof to hold it in position.

The combination of a mesh bag and gravel particles provides a ready path for the transmission of water.

It may be desirable to also provide a similar weighted member adjacent the position where the tubular member strikes the ground.

This weighted member may simply be dropped into the tubular member from the open end which is later attached to the outlet from the guttering system and which will fall downwardly until it strikes the ground. This arrangement helps maintain the tubular member in the required position and makes it somewhat difficult to cause it to be shifted.

It will be appreciated that the form of weighted member can vary widely.

What is claimed is:

1. A temporary water drainage system, comprising:

a tubular length of flexible water-proof material connectable to a water source and extending to a drainage area for delivering substantially all water received from the water source to the drainage area;

means for removably connecting an end of said tubular length of flexible water-proof material to the water source, said means for removably connecting including an adhesive; and, a weighted member in the free end of the tubular length of flexible water-proof material for locating position.

2. The temporary water drainage system according to claim 1, further comprising an additional weighted member located within said tubular length of flexible water-proof material through which water is passable.

3. The temporary water drainage system according to claim 2, wherein said additional weighted member is located within said tubular length of flexible water-proof material below an outlet for said tubular length of flexible water-proof material.

4. The temporary water drainage system according to claim 1, further comprising means for removably connecting one end of said tubular length of flexible water-proof material to the drainage area, said one end being an opposite end to the end of said tubular length of flexible water-proof material removably connected to the water source.

5. The temporary water drainage system according to claim 1, wherein said adhesive is double-sided tape connected to both the water source and said tubular length of flexible water-proof material.

6. The temporary water drainage system according to claim 1, wherein said means for removably connecting includes a physical connector passing around an exterior surface of said tubular length of flexible water-proof material.

7. The temporary water drainage system according to claim 6, wherein said physical connector is a cable tie.

8. The temporary water drainage system according to claim 6, wherein said physical connector is a clamp.

9. The temporary water drainage system according to claim 6, wherein said physical connector is a sleeve of material passable over the end of the tubular length of flexible water-proof material adjacent the water source for retaining the end against the water source.

10. The temporary water drainage system according to claims 1, further comprising an intermediate member having a flexible length of tubular material connector thereto.

11. The temporary water drainage system according to claim 1, wherein said tubular length of flexible water-proof material has a length permitting a free end thereof to be located in an area capable of delivering water from the area, either via run-off or absorption.

12. A temporary water drainage system, comprising:

a tubular length of flexible water-proof material connectable to a water source and extending to a drainage area for delivering substantially all water received from the water source to the drainage area; and, means for removably connecting an end of said tubular length of flexible water-proof material to the water source, said means for removably connecting including a physical connector passing around an exterior surface of said tubular length of flexible water-proof material and double-sided tape connected to both the water source and said tubular length of flexible water-proof material.

13. The temporary water drainage system according to claim 12, further comprising means for removably connecting one end of said tubular length of flexible water-proof material to the drainage area, said one end being an opposite end to the end of said tubular length of flexible water-proof material removably connected to the water source.

14. The temporary water drainage system according to claim 12, wherein said physical connector is a cable tie.

15. The temporary water drainage system according to claim 12, wherein said physical connector is a clamp.

16. The temporary water drainage system according to claim 12, wherein said physical connector is a sleeve of material passable over the end of the tubular length of flexible water-proof material adjacent the water source for retaining the end against the water source.

17. The temporary water drainage system according to claim 12, further comprising an intermediate member having a flexible length of tubular material connector thereto.

18. The temporary water drainage system according to claim 12, wherein said tubular length of flexible water-proof material has a length permitting a free end thereof to be located in an area capable of delivering water from the area, either via run-off or absorption.

* * * * *